US009645551B2

(12) United States Patent
Conus et al.

(10) Patent No.: US 9,645,551 B2
(45) Date of Patent: May 9, 2017

(54) METHOD OF IMPROVING THE PIVOTING OF A WHEEL SET

(71) Applicant: The Swatch Group Research and Development Ltd., Marin (CH)

(72) Inventors: Thierry Conus, Lengnau (CH); Marco Verardo, Les Bois (CH); Ivan Villar, Bienne (CH); Andres Cabezas Jurin, Yverdon (CH); Jean-Luc Helfer, Le Landeron (CH); Emmanuel Graf, Le Locle (CH)

(73) Assignee: The Swatch Group Research and Development Ltd, Marin (CH)

( * ) Notice: Subject to any disclaimer, the term of this patent is extended or adjusted under 35 U.S.C. 154(b) by 168 days.

(21) Appl. No.: 14/366,913

(22) PCT Filed: Nov. 30, 2012

(86) PCT No.: PCT/EP2012/074144

§ 371 (c)(1),
(2) Date: Jun. 19, 2014

(87) PCT Pub. No.: WO2013/092173

PCT Pub. Date: Jun. 27, 2013

(65) Prior Publication Data

US 2014/0355397 A1 Dec. 4, 2014

(30) Foreign Application Priority Data

Dec. 22, 2011 (CH) ..... 2023/11
Dec. 22, 2011 (EP) ..... 11195125

(51) Int. Cl.
*G04B 18/00* (2006.01)
*G04B 17/28* (2006.01)
(Continued)

(52) U.S. Cl.
CPC ..... *G04D 7/085* (2013.01); *G04B 1/16* (2013.01); *G04B 17/28* (2013.01); *G04B 18/006* (2013.01);
(Continued)

(58) Field of Classification Search
CPC ..... G04B 13/02; G04B 17/063; G04B 17/20; G04B 17/22; G04B 17/28; G04D 7/085; G04D 7/088; Y10T 29/49681
See application file for complete search history.

(56) References Cited

U.S. PATENT DOCUMENTS 2,239,668 A 4/1941 Aegler
2,492,066 A 12/1949 Schildmeier
(Continued)

FOREIGN PATENT DOCUMENTS

CH 390 165 12/1964
CH 649 492 A5 5/1985
(Continued)

OTHER PUBLICATIONS

International Search Report issued Feb. 26, 2013, in PCT/EP2012/074144, filed Nov. 30, 2012.

*Primary Examiner* — Vit W Miska
(74) *Attorney, Agent, or Firm* — Oblon, McClelland, Maier & Neustadt, L.L.P.

(57) ABSTRACT

A method of improving pivoting of a wheel set for a scientific instrument, including an arbor pivoting or oscillating about an axis, in which: static balancing of the wheel set is performed to bring the center of gravity onto the axis; a desired value is determined for resulting unbalance moment of the wheel set about the axis, corresponding to a predetermined divergence between a first principal longitudinal axis of inertia of the wheel set, and the axis; at a predetermined speed about the axis, the resulting unbalance
(Continued)

moment is measured with regard to the axis; and an adjustment of the resulting unbalance moment is made within a given determined tolerance with regard to the desired value, and performed by machining both sides of a median plane including the two secondary axes of inertia of the wheel set.

30 Claims, 4 Drawing Sheets

(51) Int. Cl.
*G04D 7/08* (2006.01)
*G04B 1/16* (2006.01)

(52) U.S. Cl.
CPC ..... *G04D 7/088* (2013.01); *Y10T 29/49581* (2015.01)

(56) References Cited

U.S. PATENT DOCUMENTS

| | | | | |
|---|---|---|---|---|
| 2,958,997 | A | 11/1960 | Jahn | |
| 3,349,640 | A * | 10/1967 | Schneiter | F16F 15/32 368/169 |
| 4,626,147 | A | 12/1986 | Nystuen et al. | |
| 5,111,713 | A | 5/1992 | Cameron et al. | |
| 8,550,699 | B2 * | 10/2013 | Buhler | G04B 17/063 368/169 |
| 2003/0179655 | A1 * | 9/2003 | Scheufele | G04B 18/006 368/127 |
| 2010/0061822 | A1 | 3/2010 | Gerber | |
| 2013/0188461 | A1 * | 7/2013 | Mallet | G04B 17/063 368/173 |
| 2014/0071796 | A1 * | 3/2014 | Damasko | G04B 17/063 368/171 |

FOREIGN PATENT DOCUMENTS

| | | |
|---|---|---|
| EP | 0 434 270 A2 | 6/1991 |
| EP | 0 657 727 A1 | 6/1995 |
| EP | 2 395 402 A1 | 12/2011 |
| FR | 1206719 | 2/1960 |
| WO | 2008/067683 A1 | 6/2008 |

* cited by examiner

METHOD OF IMPROVING THE PIVOTING OF A WHEEL SET

CROSS-REFERENCE TO RELATED APPLICATIONS

This is a National Phase application in the United States of International Patent Application PCT/EP2012/074143 filed Nov. 30, 2012 which claims priority on European Patent Application No. 11195125.7 filed Dec. 22, 2011. The entire disclosures of the above patent applications are hereby incorporated by reference.

FIELD OF THE INVENTION

The invention concerns a method of improving the pivoting of a wheel set or of an equipped wheel set for a scientific instrument or timekeeper, including at least one arbor arranged to pivot or oscillate about an axis of oscillation aligned on a wheel set axis formed by the axis of said arbor.

The invention further concerns a wheel set for a scientific instrument or timekeeper, including at least one arbor arranged to pivot or oscillate about an axis of oscillation aligned on a wheel set axis formed by the axis of said arbor, and including at least one flange connected to said wheel set arbor and projecting radially in relation to said arbor, said flange being substantially perpendicular to said wheel set axis.

The invention further concerns an equipped wheel set for a scientific instrument or timekeeper including a wheel set of this type.

The invention further concerns a mechanism for a scientific instrument or timekeeper including an equipped wheel set of this type and/or a wheel set of this type.

The invention also concerns a scientific instrument including this type of mechanism and/or an equipped wheel set of this type and/or a wheel set of this type.

The invention concerns the field of precision mechanics, notably mechanical scientific instruments, and in particular the fields of counters and precision instruments including mechanisms for measuring, displaying or comparing a flow rate, a consumption, or a time, including components which pivot or oscillate about an axis.

BACKGROUND OF THE INVENTION

In the field of precision mechanical instruments, the quality of the guide members of certain components, which pivot or oscillate about an axis, is of great importance for the reproducibility over time of measurements made or signals generated. Any defects in the guide members, between, on the one hand, the pivots of a mechanism, and on the other hand, shoulders comprised in an arbor of the component, result in mediocre precision, and also wear and impaired performance over time. The geometric quality of machining operations is a necessary condition for precision operation, but this condition is often insufficient. Indeed, vibration behaviour, in particular in the presence of unbalances, directly affects the pressure applied to the bearings, and therefore lubrication requirements and maintenance requirements, in particular when the bearings and/or pivots are replaced or re-machined to re-establish the quality of the guide members after wear.

A static balancing of the components, returning their centre of mass to the axis of pivoting or oscillation, improves the situation and makes it possible to delay wear.

However, the effects caused by inertial defects lead to considerable disruptions in the operation of the mechanism, and the service life over time.

SUMMARY OF THE INVENTION

The invention proposes to provide a solution to ensure a reduction in friction in the guide members of the rotating components of these precision mechanisms, and to improve the operating precision of such mechanisms. It also intends to allow an increase in the speeds of rotation and/or the oscillation frequencies of the components concerned.

Seeking greater precision means seeking improved adjustment of the wheel set, in particular by means of a high quality dynamic balancing operation.

The invention therefore proposes to dynamically balance the wheel set, i.e. return it to its principle axis of inertia on the axis of rotation.

To this end, the invention concerns a method of improving the pivoting of a wheel set or of an equipped wheel set for a scientific instrument or timekeeper, including at least one arbor arranged to pivot or oscillate about an axis of oscillation aligned on a wheel set axis formed by the axis of said arbor, characterized in that:

- static balancing of said wheel set is performed to bring the centre of gravity onto said wheel set axis;
- a desired value is determined for the resulting unbalance moment of said wheel set about said wheel set axis, corresponding to a predetermined desired divergence between a first principal longitudinal axis of inertia of said wheel set, and said axis of the wheel set.
- said wheel set is set in rotation at a predetermined speed about said wheel set axis, the resulting unbalance moment is measured with regard to said wheel set axis;
- an adjustment is made to the value of the resulting unbalance moment of said wheel set around said wheel set axis within a given determined tolerance with regard to said desired value
- said adjustment is performed by machining both sides of a median plane including the two secondary axes of inertia of said wheel set.

According to another characteristic of the invention, said adjustment is made by the asymmetrical addition and/or displacement and/or removal of material in relation to a plane defined by the two other principal axes of inertia of said wheel set or equipped wheel set.

The invention also concerns a wheel set for a scientific instrument or timekeeper, including at least one arbor arranged to pivot or oscillate about an oscillation axis aligned on a wheel set axis formed by the axis of said arbor, and including at least one flange connected to said wheel set arbor and projecting radially in relation to said arbor, said flange being substantially perpendicular to said wheel set axis, characterized in that said wheel set is manufactured to include a first principal longitudinal axis of inertia close to said wheel set axis or coincident therewith, and two other principal axes of inertia defining together a median plane, and in that said flange includes a plurality of housings each receiving a movable mass whose position is adjustable in said housing concerned, either only in the axial direction parallel to said wheel set axis, or only in a plane perpendicular to a radial line originating from said wheel set axis.

According to a characteristic of the invention, said median plane is within the thickness of said flange.

The invention also concerns an equipped wheel set for a scientific instrument or timekeeper including a wheel set of this type, characterized in that it also includes a drive means, and/or an elastic means of return or repulsion, and/or a magnetic means of return or repulsion, and/or an electrostatic means of return or repulsion.

The invention further concerns a mechanism for a scientific instrument or timekeeper including an equipped wheel set of this type and/or a wheel set of this type.

The invention also concerns a scientific instrument including this type of mechanism and/or an equipped wheel set of this type and/or a wheel set of this type.

BRIEF DESCRIPTION OF THE DRAWINGS

Other features and advantages of the invention will appear upon reading the following detailed description, with reference to the annexed drawings, in which:

FIG. 5 shows a cross-section, with a deformable strip with a component in the axial direction of the wheel set, the deformation of each strip being imparted by an adjustment screw.

FIG. 6 shows a mass that is angularly orientable in relation to an aperture comprised in the wheel set flange, and including an arc supported on a first edge and under a second edge of this aperture.

FIG. 7 shows adjustment screws in a flange of the wheel set, mounted parallel to the axial direction of the wheel set.

FIG. 8 shows screws similar to those of FIG. 7, arranged alternately on and under a flange of the wheel set.

FIG. 9 shows adjustment screws within the thickness of a flange of the wheel set, mounted in a median plane of the flange in radial directions in relation to the wheel set axis, these screws including heads that are not of revolution, but which are symmetrical to the axis of screwing.

FIG. 10 is similar to FIG. 9, but with screw heads that are asymmetrical to the axis of screwing.

FIG. 11 shows a flange including a peripheral portion linked to an axial core by attachment portions, this peripheral portion being slotted and deformable at the different segments comprised therein, each borne by one of the attachment pieces.

DETAILED DESCRIPTION OF PREFERRED EMBODIMENTS

The invention concerns the field of mechanical scientific instruments, and in particular the fields of counters and precision instruments including mechanisms for measuring or comparing time, including movable components which can pivot or oscillate about an axis.

More specifically the invention is concerned with the optimum balancing of a wheel set 1 or an equipped wheel set 40.

Figure 1:
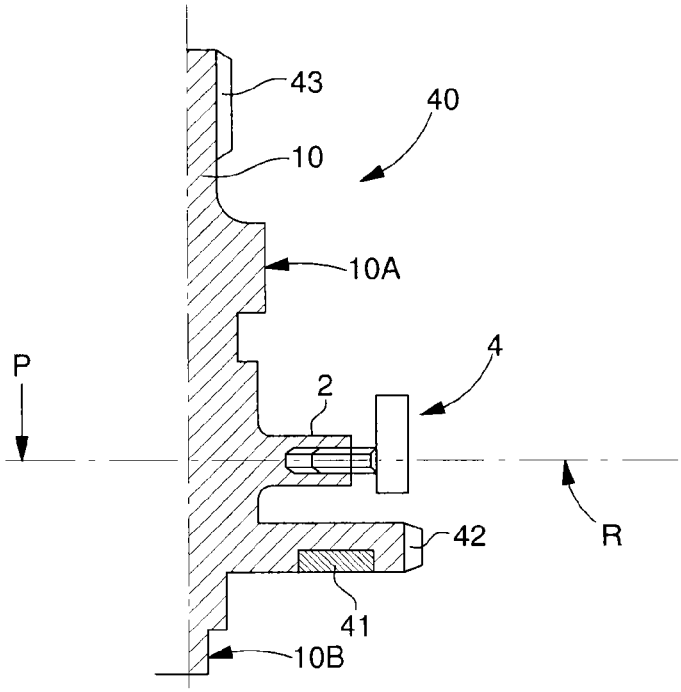
FIG. 1 shows a schematic, longitudinal cross-section of an example of an equipped wheel set according to the invention.

In the following description, "wheel set" means any arbored component that can pivot or oscillate about a wheel set axis D, corresponding to the axis of the arbored part. This wheel set may, where appropriate, but not necessarily, include toothings, pinions, other drive means such as grooves or shoulders, and elements for attachment or cooperation with a drive means, and/or an elastic means of return or repulsion, and/or a magnetic means of return or repulsion, and/or an electrostatic means of return or repulsion, or suchlike. Here "equipped wheel set" 40 means a mechanical sub-assembly or assembly including at least one wheel set 1 of this type and all or part of a drive means, and/or an elastic means of return or repulsion, and/or a magnetic means of return or repulsion, and/or an electrostatic means of return or repulsion. FIG. 1 illustrates a non-limiting example of an equipped wheel set 40 of this type, formed on the one hand of a wheel set 1, and on the other hand of magnetic means of repulsion 41. Wheel set 1 includes an arbor 10, of axis D, in this example a toothed wheel 42 and a pinion 43, and a flange 2 carrying a means of adjustment 4, shown here in a radial arrangement in a radial direction R to axis D and in a median plane P corresponding to the secondary theoretical axes of inertia, the principal theoretical axis of inertia being coincident with axis D. This equipped wheel set 40 thus includes a flange 2.

"Flange" means a part projecting substantially radially, preferably of revolution about the wheel set axis, and whose diameter is larger than that of the arbor. The same wheel set may naturally include several flanges of this type, of which some may have specific functions, such as toothed wheels, pulleys, or suchlike.

The invention proposes to dynamically balance wheel set 1, or equipped wheel set 40, i.e. return it to its principal axis of inertia on the axis of rotation. The different non-limiting embodiments and the Figures illustrate the application of the invention to a bare wheel set 1 and are, of course, applicable to an equipped wheel set 40.

Other than seeking perfect balancing, it is also possible to create controlled unbalance, i.e. to incline the principal axis of inertia of the wheel set at a certain angle in a certain direction in relation to:

- the wheel set axis;
- a plane passing through this wheel set axis and materialized by a functional guide-mark, particularly an angular guide-mark of the wheel set.

For this two steps are necessary:

- measuring the dynamic unbalance
- correcting this unbalance, either by cancelling it out, or by returning it to a well-defined value.

To this end, the invention concerns a method for improving the pivoting of a wheel set 1 or an equipped wheel set 40 for a scientific instrument or timekeeper. This wheel set 1 includes at least one arbor 10 arranged to pivot or oscillate about an axis of oscillation aligned on the wheel set axis D formed by the axis of arbor 10, and preferably at least one flange 2 whose footprint diameter is greater than that of arbor 10. In the case of a wheel set reduced simply to arbor 10, it remains possible to perform dynamic balancing by using certain implementation variants of the invention, applicable to an arbor of this type. Only the variants set out below, which require components supported on both sides of a thin flange and which are difficult to implement on a substantially cylindrical arbored part, will be more restricted to wheel sets including a flange that is substantially flat and substantially perpendicular to the wheel set axis.

This wheel set 1 or equipped wheel set 40 is arranged to oscillate about an oscillation axis aligned on wheel set axis D.

According to the invention:

static balancing of this wheel set or equipped wheel set is performed to bring the centre of gravity onto wheel set axis D;

a desired value is determined for the resulting unbalance moment, defining its dynamic unbalance, for the wheel set or equipped wheel set about the wheel set axis, corresponding to a desired divergence, in particular in some applications a predetermined desired divergence between a first principal longitudinal axis of inertia of the wheel set, and the axis of the wheel set D;

this wheel set or equipped wheel set is set in rotation at a predetermined speed about wheel set axis D, and the resulting unbalance moment is measured in relation to wheel set axis D, with at least one measurement;

an adjustment is made to the value of the resulting unbalance moment of the wheel set about the wheel set axis within a given determined tolerance in relation to the desired value. The effect of this adjustment is to bring the first principal longitudinal axis of inertia on the one hand closer to the wheel set axis on the other, below the predetermined desired divergence.

In a specific implementation, this adjustment is performed by machining both sides of a median plane P including the two secondary axes of inertia of the wheel set.

In a specific implementation, the predetermined tolerance range includes an upper limit corresponding to the desired value. In other applications, the tolerance range is around this desired value.

Preferably, said desired value of the resulting unbalance moment is determined in the form of a maximum admissible value of the resulting unbalance moment of the wheel set or equipped wheel set about the wheel set axis. This maximum value corresponds to a predetermined maximum angular divergence between the first principal longitudinal axis of inertia of the wheel set or equipped wheel set on the one hand, and the wheel set axis on the other. The adjustment of the value of the dynamic balance moment of the wheel set or equipped wheel set therefore has the effect of bringing the first principal longitudinal axis of inertia closer to the wheel set axis, below the predetermined maximum angular divergence.

In a specific implementation of the invention, this adjustment is made by the asymmetrical addition and/or displacement and/or removal of material in relation to a plane defined by the two other principal axes of inertia of the wheel set or equipped wheel set.

In a specific embodiment, an addition and/or displacement and/or removal of material is carried out on at least one flange comprised in the wheel set, projecting radially in relation to its arbor.

In a specific embodiment, an addition and/or displacement and/or removal of material is carried out on the arbour of wheel set 1 or of equipped wheel set 40.

In a specific embodiment, an addition and/or displacement and/or removal of material is carried out on least one arm comprised in wheel set 1 or equipped wheel set 40 between said arbor and another off-centre part of the wheel set.

In a specific implementation of the invention, the static balancing is performed prior to the adjustment of the value of the dynamic balance moment.

In a further specific implementation of the invention, the static balancing is performed simultaneously with the adjustment of the value of the dynamic balance moment.

In a specific implementation of the invention, this maximal admissible value of the resulting unbalance moment of the wheel set or equipped wheel set about the wheel set axis is set at zero, so as to make the first principal longitudinal axis of inertia of the wheel set or equipped wheel set coincident with the axis of the wheel set.

In a specific implementation of the invention for an oscillating wheel set, this predetermined speed of rotation is set at the maximum angular speed calculated for the wheel set or equipped wheel set, considered during its oscillation in use.

In a specific implementation of the invention, prior to the static balancing and dynamic balancing, on flange 2 when the wheel set includes one, cylindrical or fluted housings, arranged to receive movable cylindrical or fluted masses, are machined in an axial direction parallel to the wheel set axis. All or part of the adjustment is then carried out by moving these movable masses inserted into some of these housings, in relation to the plane defined by the two other principal axes of inertia of the wheel set or equipped wheel set. If no flange is present, the housings are machined in wheel set arbor 10.

In a specific implementation of the invention, prior to the static balancing and dynamic balancing, these movable masses are confined in and made inseparable from the flange, either by creating a wheel set or equipped wheel set in a single piece with these movable masses, or by extending at least one end of each movable mass to prevent the extended area from passing through the corresponding housing for said movable mass.

According to a specific implementation of the invention, all or part of this adjustment is carried out by deforming a flange 2 comprised in the wheel set or equipped wheel set, in an asymmetrical manner in relation to the plane defined by the two other principal axes of inertia of the wheel set or equipped wheel set.

In a specific implementation of the invention, prior to the static balancing and dynamic balancing, a flange 2, comprised in the wheel set or equipped wheel set, is machined with internally threaded radial housings arranged to receive asymmetrical headed screws movable in a radial direction in relation to the wheel set axis, and all or part of said adjustment is carried out by moving these screws screwed into some of the internally threaded housings. If no flange is present, internally threaded housings of this type are machined in the wheel set arbor 10.

In a specific implementation of the invention, when the resulting unbalance moment of the wheel set or equipped wheel set is measured in relation to the wheel set axis, the unbalance is noted in an angular position in relation to an angular guide-mark on the wheel set or equipped wheel set, such as a pin, a notch, a piercing, an additional component, a mark, or suchlike.

Figure 16A:
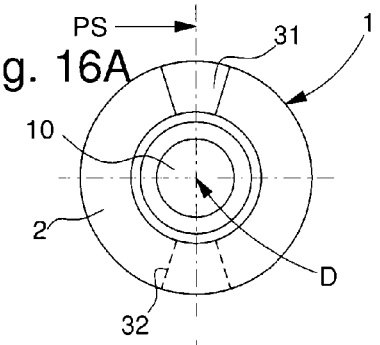
FIGS. 16A and 16B show an end and side view of a pre-embodiment of the wheel set with an imposed or forced resulting moment of unbalance.
Figure 16B:
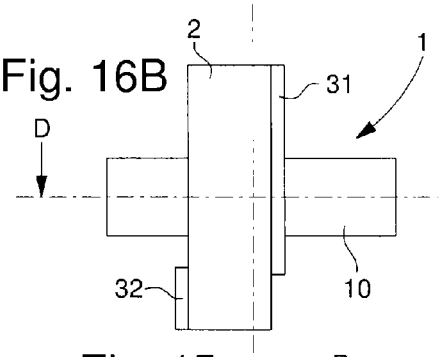

In a specific implementation of the invention, prior to the static balancing and dynamic balancing, a flange, which is comprised in the wheel set or equipped wheel set, is machined to be out of truth in the flat by a predetermined value. In particular, in a specific embodiment, an unbalance and/or resulting unbalance moment are intentionally created in a specific angular direction, and in an offset manner in relation to the median plane P. FIGS. 16A and 16B thus illustrate portions of excess thickness 31 and 32 on both sides of plane P, and substantially defining together a plane PS passing through the wheel set axis D. Hence, a large controlled unbalance is created, which facilitates fine corrections of the unbalance for static balancing and dynamic balancing. Thus, correction is forced in a certain area around plane PS passing through axis D.

As discussed in the 'Illustrated Professional Dictionary of Horology,' the term 'out of truth in the flat' means 'not in its proper position in relation to the vertical or to an arbor' and the cause for the flange not being in its proper position may be due to one of the following: i) the plane of the wheel is not perpendicular to the arbor, ii) the plane of the wheel is perpendicular to the arbor but the wheel is of uneven thickness, and iii) the plane of the wheel is perpendicular to the arbor but the latter is bent.

In order to correct the unbalance, the following non-limiting methods can advantageously be used, combinable with each other, and applicable on a flange 2 or a wheel set arbor 10, or even a connecting arm between the arbor and a peripheral mass, or on a peripheral mass of this type.

- removal of material: machining by milling or turning or abrasion or suchlike, laser or micro laser or nano laser or pico laser or femto laser ablation, breaking off divisible elements held by fragile attachment pieces.
- addition of material: projection of liquid for solidification on the wheel set, in particular by ink jet or such like, solid objects inserted in a fixed position.
- displacement of material: inserted objects with an adjustable position, displacement of at least part of the flange or a part of the wheel set, or of an arm, displacement of a flexible strip, displacement of a screw or smooth or fluted or facetted screws or inserts; these screws or inserts may advantageously be asymmetrical in relation to their direction of insertion or screwing.

The Figures show, in a non-limiting manner, adjustments carried out on a wheel set flange, as it is easier to make an inertia correction in proximity to the largest diameter of the wheel set, which means that only minimal mass corrections are required. In order to simplify the diagram, only the flange is shown; the wheel set arbor is not fully shown. Naturally, the described arrangements are also applicable to other forms of wheel sets, and the adjustable machined portions or components may be positioned on other parts of the wheel set, according to their accessibility.

Figure 2A:
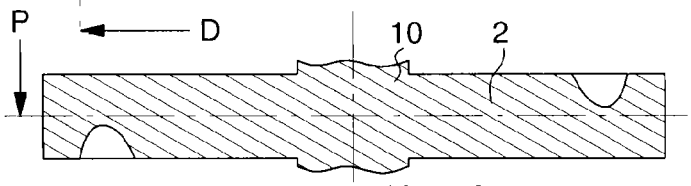
FIG. 2 shows a schematic cross-section along a plane through the wheel set axis, different variants 2A to 2F of machining operations that can be performed to implement the static and dynamic balancing method according to the invention.
Figure 2B:
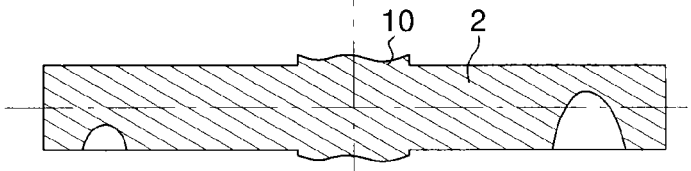
Figure 2C:
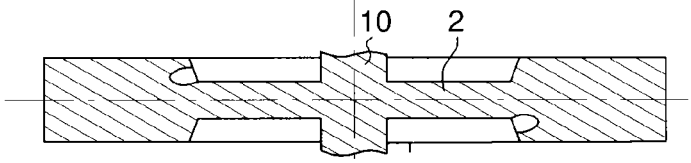
Figure 2D:
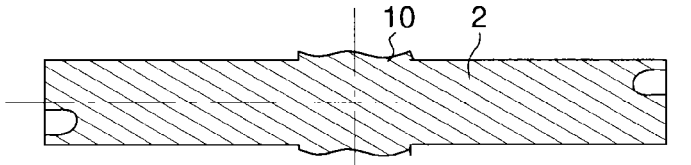
Figure 2E:
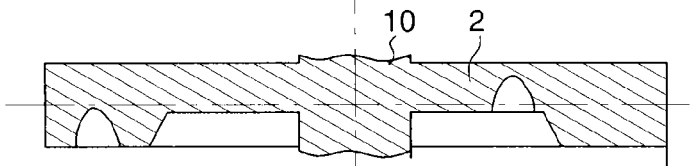
Figure 2F:
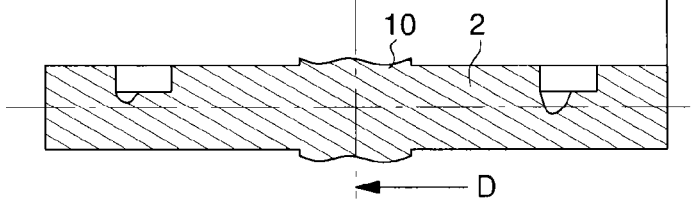

With more specific reference to the removal of material, FIGS. 2A to 2F show different variants of the balancing elements machined in a flange 2 of wheel set 1, FIG. 2F shows in particular a machined balancing element concealed at the base of a groove for aesthetic reasons.

Advantageously, when, preferably, the theoretical principal axis of inertia is formed by wheel set axis D, and the median plane P is calculated to include the two secondary axes of inertia, the machined elements are created on both sides of plane P. The Figures show, in a non-limiting manner, different possibilities: on both sides of the median plane (FIGS. 2A, 2C, 2D, 2E), interior/exterior machined elements in relation to the flange (FIGS. 2C, 2D), having different volumes and radial positions in relation to the wheel set axis (FIG. 2B), machined elements created axially from the same side of the flange (FIGS. 2B, 2E) or from opposite sides (FIG. 2A).

Thus, in these variants, it is possible, in particular to:

- form machined portions, on both sides of median plane P, with different volumes with respect to wheel set axis D;
- form machined portions, on both sides of median plane P, with different radial positioning with respect to wheel set axis D;
- form machined portions, on both sides of median plane P, axially parallel to wheel set axis D, from the same side of flange 2;
- form machined portions on both sides of median plane P, axially parallel to wheel set axis D, on opposite sides of flange 2.

It is of course possible to combine these machining variants with each other.

Naturally, the possibilities for distribution are similar with regard to the addition or displacement of material.

In an advantageous implementation, prior to the static balancing of wheel set 1 or of equipped wheel set 40, flange 2 is machined to be out of truth in the flat by a predetermined value, with a resulting unbalance moment in a specific angular direction and having a predetermined value, and off-centre in relation to median plane P.

Flange 2 is advantageously made with portions of excess thickness 31, 32, on both sides of median plane P, which substantially define together a plane PS passing through wheel set axis D, said portions of excess thickness 31, 32 forming together a controlled unbalance, and the correction is forced in a certain area around this plane PS.

Figure 3A:
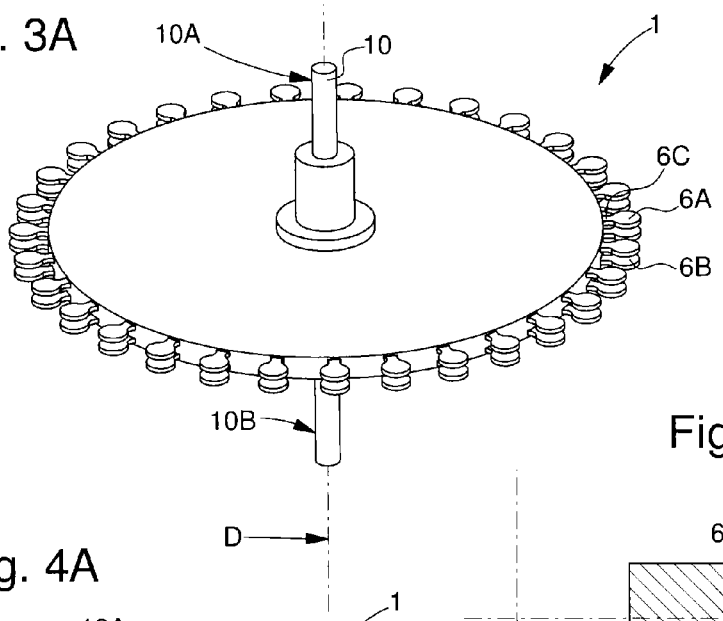
FIG. 3A is a perspective view, with inertia blocks that can be cut and/or folded distributed on both sides of the median plane of a flange of the wheel set, as shown in the cross-section of FIG. 3B along a plane through the wheel set axis.
Figure 3B:
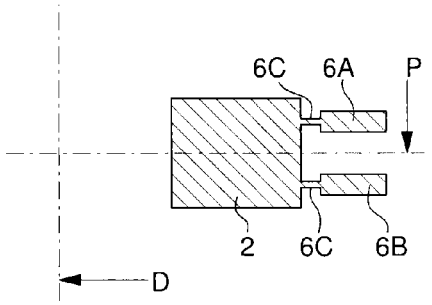
FIGS. 3 to 11 show partial and schematic views of other variants of the wheel set according to the invention.

FIGS. 3A and 3B show a wheel set 1 including inertia-blocks 6A and 6B which may be cut and/or folded, arranged on both sides of a median plane P of flange 2. The breaking of a fine attachment piece 6C makes it possible to obtain an inertial differential in relation to axis D, and the large number of inertia-blocks 6, around thirty per level in the example in the Figure, allows adjustment in relation to the direction of the measured resulting moment of unbalance.

Figure 11:
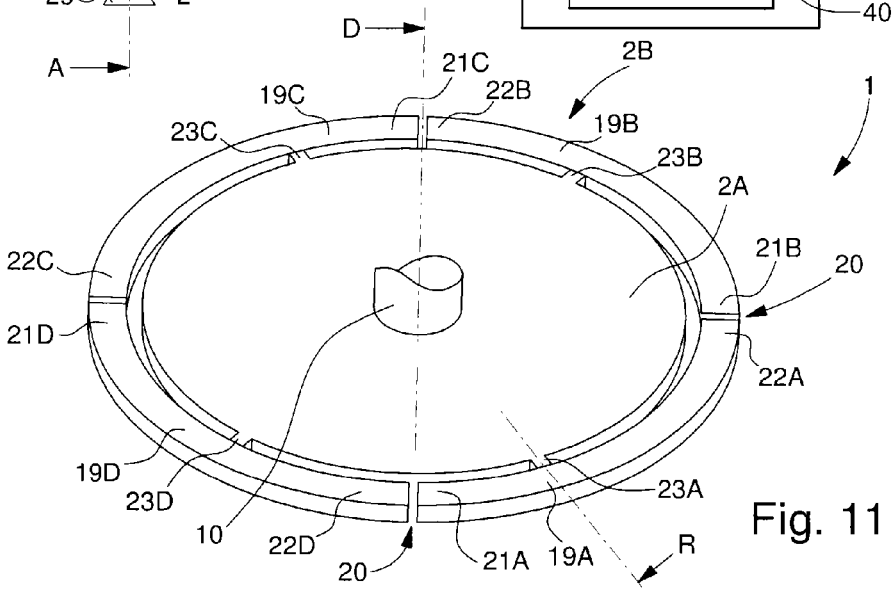

FIG. 11 shows a flange 2 including a peripheral portion 2B linked to an axial core 2A by attachment pieces 23A, 23B, 23C, 23D, this peripheral section 2B being divided by slots 20 and adjustable by means of the different segments 19A, 19B, 19C, 19D comprised therein, each borne by one of the attachment pieces. Preferably, all or part of the attachment pieces 23A, 23B, 23C, 23D are plastically deformed in order to straighten or conversely cause undulations in flange 2. Thus, for example, an attachment piece 23A bears a sector-shaped segment 19A, whose ends 21A and 22A are movable in relation to the radial direction R of the attachment piece concerned, here 23A, and, by twisting this attachment piece, the two extremities are moved apart, on both sides of the median plane of the flange at rest. Each attachment piece 23A, 23B, 23C, 23D may be deformed independently of the others. In another embodiment, the attachment piece may be rigid, and the sector of the flange deformable. In yet another embodiment they may both be deformable, although the measurement is more difficult, especially in case of reverse adjustment.

FIGS. 1, 4 to 10, and 12 to 14, show variants of the wheel set including inserted components.

Figure 12:
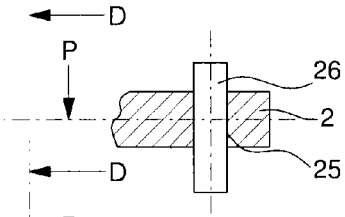
FIG. 12 shows, in a schematic cross-section along a plane through the wheel set axis, a smooth mass whose axial position is adjustable in a housing.
Figure 13:
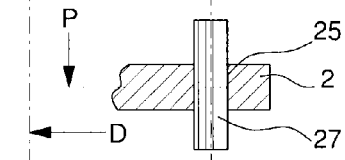
FIG. 13 similarly shows a fluted mass and FIG. 14 likewise shows a mass held in position by a flange of the wheel set.
Figure 14:
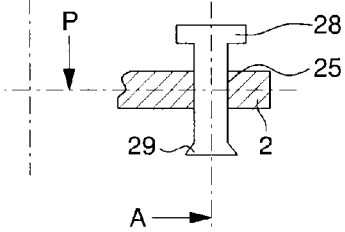
Figure 15:
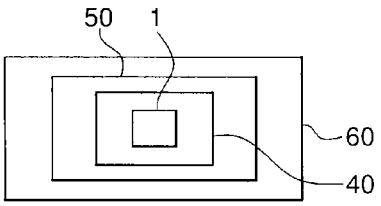
FIG. 15 shows a schematic block diagram of a scientific instrument including a mechanism with an equipped wheel set according to the invention.

FIG. 12 shows a smooth mass 26, whose axial position can be adjusted in a housing 25, in a direction A parallel to wheel set axis D. FIG. 13 shows a fluted mass 27 movable in an ad hoc housing. FIG. 14 similarly shows a mass held in relation to flange 2 of wheel set 1, with a head 28 on one side of flange 2, and a rivetable lip 29 or a headed extension on the other side of flange 2. The displacement in direction A makes a dynamic balancing adjustment possible, the smooth masses 26 or fluted masses 27 may even be graduated or notched in direction A to facilitate adjustment, according to a calculation carried out by a means for controlling the dynamic balancing.

Figure 7:
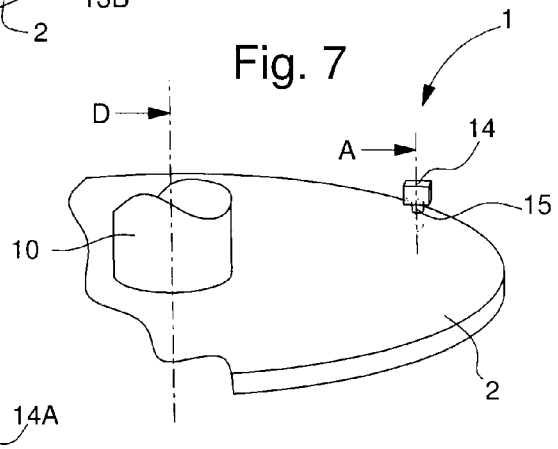
Figure 8:
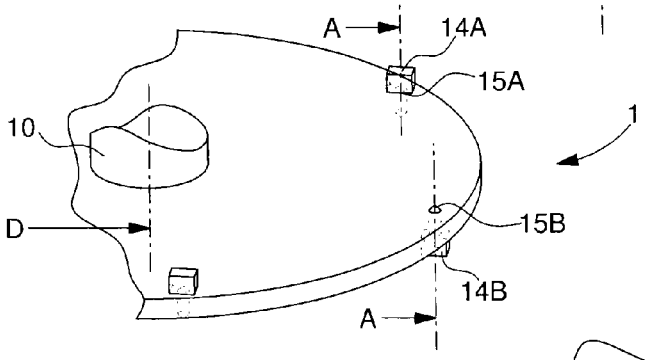

FIG. 7 shows adjustment screws 14 in housings 15 of flange 2, mounted in parallel in direction A to the axial direction D of wheel set 1. FIG. 8 includes adjustment screws 14 similar to those in FIG. 7, arranged alternately above (screw 14A) and below (screw 14B) flange 2 of wheel set 1, in the corresponding housings 15A and 15B. Naturally, the reverse mounting, with a nut on an externally threaded arbor, is also suitable. In both cases, it is advantageous to use a slightly different pitch for the male component and the female component to improve serviceability.

An additional component is advantageously movably mounted on the wheel set structure. To this end, wheel set 1 includes a slidably movable part that is driven on, or clipped or mounted with play, either in rotation or axially. Providing at least one guide surface using notches or suchlike makes it possible for the additional component to assume discrete positions.

The mobility of the additional component may also be achieved by screwing/unscrewing.

Figure 4A:
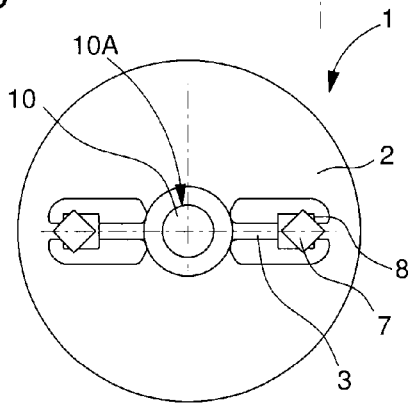
FIG. 4A is a top view, and FIG. 4B, a cross-section, with movable masses on or under the rails incorporated in the apertures in a wheel set flange.
Figure 4B:
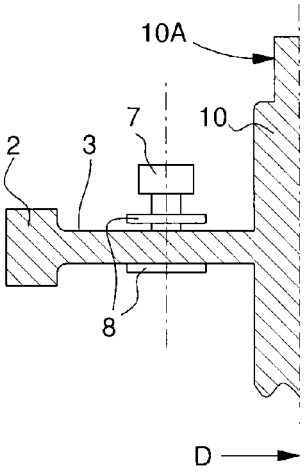

An adjustment component can thus be mounted with play, and tightened by a screw, by sliding for example. Thus, FIGS. 4A and 4B show movable masses on or under rails 3 incorporated in apertures in a flange 2 of wheel set 1. These movable masses are formed in particular by sliding clamp straps 8 each including a fixing screw 7, here shown according to an axial direction A parallel to axis D of wheel set 1. The screw 7, and above all the head of this screw, may be placed on one side or the other of wheel set 1. Otherwise, the entire clamp strap 8, equipped with its screw 7 is placed on a rail 3 in such a way as to present the head of the screw 7 on one side or other of the wheel set 1.

The adjustment component may also be clipped on an arm 3 or on flange 2 of wheel set 1. For example, it may consist of a flexible object clipped on a rigid part, for example an inertia-block on an arbor, or even of a rigid object clipped on a flexible part, for example an arbor in a slot.

An adjustable component may also be an additional component simply bonded, welded or even riveted to the structure of the wheel set.

In a variant of the embodiment, a flexible additional object is made to bend.

Figure 5:
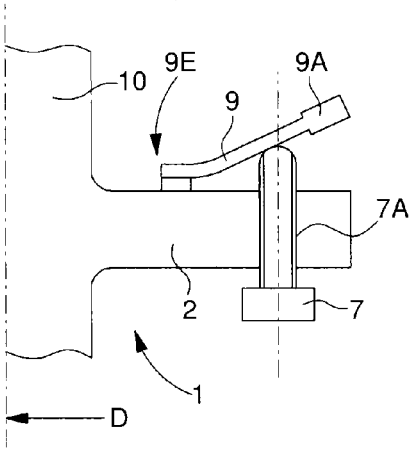

FIG. 5 shows, in a first variant, a wheel set 1 with at least one adjustable strip 9 with a component according to axial direction A parallel to wheel set axis D. The deformation of each strip 9 is imparted by an adjustment screw 7, shown here fixed in an internally threaded housing 7A of rail 3. In a variant that is not shown, screws of this type may also be borne by flange 2. Advantageously, wheel set 1 is equipped on each side with at least one flexible strip 9. The inertia differential adjustment is procured both by the displacement of each adjustment screw 7 in its direction A, and by the deformation of the corresponding flexible strip 9. Preferably, as seen in the Figure, flexible strip 9 is held at only one end 9E thereof, close to the axis of wheel set 1, and is free at the other end, which includes advantageously an additional mass 9A. It is understood that deformable strip 9 may be devised for use within an elastic deformation domain, with a view to subsequent adjustments, or even within the plastic deformation domain, in the case of a single adjustment of the wheel set. Although the example in the Figure shows the flexible strip deformed by a screw, it is naturally also possible to envisage a deformation controlled by means of a nut, or another movable or adjustable component.

A second variant of this adjustment by bending employs a displacement of the fixing of the flexible part, which may be provided with notches, and with the flexible part supported against a cam or a fixed area.

Figure 6:
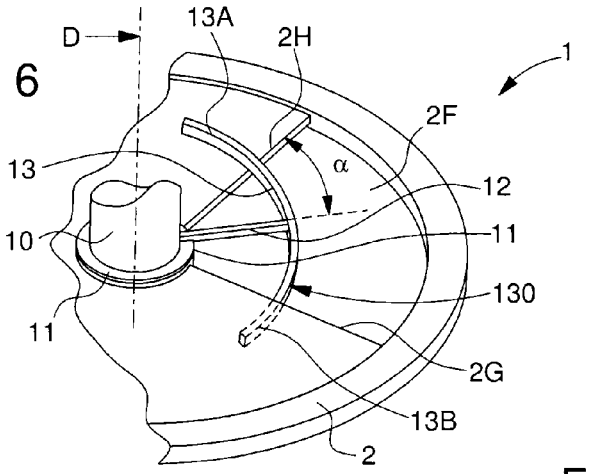

Thus, FIG. 6 shows a mass 130 that is angularly orientable in relation to an aperture 2F comprised in a flange 2 of wheel set 1, and including an arc 13 supported on a first edge 2H and under a second edge 2G of this aperture 2F. Mass 130 can be angularly oriented in relation to flange 3 at a central angle $\alpha$. This orientable mass 130 includes a support washer 11 abutting on a shoulder of wheel set 1, in particular on a shoulder of arbor 10. This support washer 11 is fixed to an arm 12, which is preferably flexible, and in turn secured to arc 13, which preferably has greater torsional rigidity than arm 12. This arc 13 is supported, at one end 13A on a first edge 2H, and at a second end 13B under a second edge 2G of aperture 2F. The pivoting imparted to orientable mass 130 forces it to adopt a particular twist which makes it possible to modify the dynamic balancing of wheel set 1. In another embodiment, arm 12 is rigid, and arc 13 is deformable. In yet another embodiment they may both be deformable, although the measurement is more difficult, especially in case of reverse adjustment.

In order to avoid creating an unbalance, it is possible to use additional components with a fixed position in projection in median plane P, and movable in an axial direction A parallel to axis D of wheel set 1. This is particularly the case for the embodiments in FIGS. 7 and 8 where the projection in plane P of the centre of inertia of each adjustment component or screw 14 remains immobile when the adjustment component is moved.

In a specific arrangement, the adjustment components are arranged symmetrically in pairs in relation to axis D of wheel set 1. Thus, the symmetrical adjustment of the components in a pair of this type does not impair the static balancing of the wheel set.

If necessary, each adjustment component can be moved independently of the others.

Figure 9:
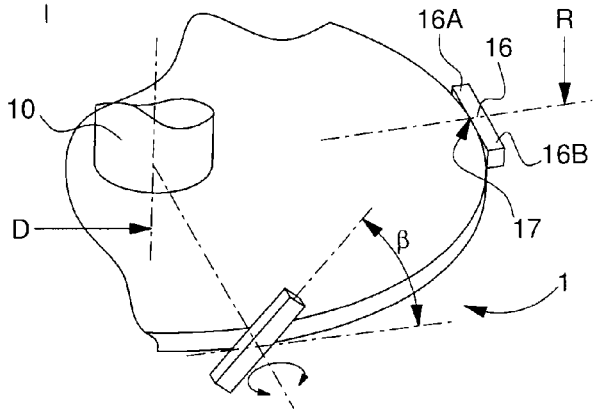
Figure 10:
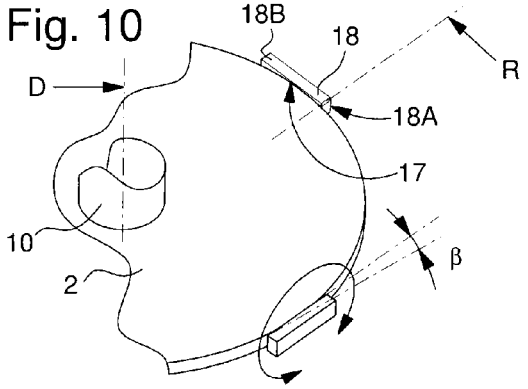

FIGS. 9 and 10 show two possible applications.

In the first case, the centre of inertia of the adjustment component is situated on the axis of rotation of this component, and/or this component is in translation along an axis. If the centre of inertia is moved along the axis, for example during screwing-in, and if the projection in median plane P of the centre of inertia of the component also moves, the object opposite must be moved in a symmetrical manner. Otherwise, each adjustment component can be moved independently.

FIG. 9 shows this configuration, with a wheel set 1 including adjustment screws 16 mounted in housings 17 in flange 2, preferably mounted in median plane P of flange 2 in radial directions R in relation to wheel set axis D. These adjustment screws 12 include heads which are not of revolution, but which are symmetrical to the axis of screwing R, and wherein the angular position of wings 16A and 16B allows modification of the dynamic balancing. In the preferred embodiment of FIG. 9 for this configuration, the screw head takes the form of a bar. The projection of this bar in a plane tangent to flange 2 occurs at an angle $\beta$ similar to a helix angle. Thus, wings 16A and 16B are either both in the same plane P in a single angular position where $\beta=0$, or on both sides of plane P for the other values of the angle $\beta$.

In a second case, the centre of inertia of the adjustment component is situated outside the axis of rotation of the component. It is therefore necessary to perform a symmetrical rotation of the opposite component in the pair.

This is the case in FIG. 10, where wheel set 1 includes an asymmetrical adjustment screw 18 whose head is asymmetrical in relation to the axis of screwing, and includes a wing 18B with a moment of inertia higher than that of the other wing 18A in relation to the radial axis of screwing R. As in the previous case, the screw head has the form of a bar. The projection of this bar in a plane tangent to flange 2 occurs at an angle γ similar to a helix angle, and as seen in the Figure, the components are oriented in pairs symmetrically in relation to their respective radial axis R.

The invention also concerns a wheel set 1 for a scientific instrument or time keeper, including at least one flange 2 connected, either directly or by means of an arm, to a wheel set arbor 10 aligned on a wheel set axis D. This flange 2 is preferably substantially perpendicular to wheel set axis D. Wheel set 1 is arranged to oscillate about an oscillation axis aligned on wheel set axis D.

According to the invention, this wheel set 1 is manufactured to include a principal longitudinal axis of inertia close to wheel set axis D or coincident therewith, and two other principal axes of inertia defining together a median plane P. In a specific embodiment, this median plane P is within the thickness of flange 2.

Flange 2 includes a plurality of housings each receiving a movable mass, which is position adjustable in the housing concerned, either only in a direction A parallel to the wheel set axis, or only in a plane perpendicular to a radial line R originating from wheel set axis D.

In a specific implementation of the invention, each housing of this type and/or each corresponding movable mass includes arresting means to allow the movable mass to be held in several distinct positions where its centre of gravity is remote from median plane P.

In a specific implementation of the invention, each housing of this type and/or each movable mass includes elastic return means for holding the movable mass in position in the housing.

The invention further concerns an equipped wheel set 40 for a scientific instrument or timekeeper including a wheel set 1 of this type, and also including at least one drive means, and/or an elastic means of return or repulsion, and/or a magnetic means of return or repulsion, and/or an electrostatic means of return or repulsion, attached to this at least one wheel set.

The invention further concerns a mechanism 50 for a scientific instrument or timekeeper including an equipped wheel set 40 of this type and/or a wheel set 1 of this type.

The invention also concerns a scientific instrument 60 including this type of mechanism 50 and/or an equipped wheel set 40 of this type and/or a wheel set 1 of this type.

In a specific application, this scientific instrument 60 is a watch, and the wheel set 1 is a balance, whose flange 2 is formed by a disc or a felloe, the equipped wheel set 40 is a sprung balance.

The invention allows for a substantial reduction in the stress on the pivots, facilitates lubrication, and increases the service life of the mechanisms, and in particular the useful service life, i.e. the period in which the mechanism provides a reproducible response to an identical solicitation from an energy source, or from a signal, or from another mechanism or sensor, or suchlike. The invention makes it possible to improve the stability of operation of a wheel set dynamically balanced in this manner.

The invention claimed is:

1. A method of improving the pivoting of a wheel set or of an equipped wheel set for a scientific instrument or timekeeper, including at least one arbor arranged to pivot or oscillate about an axis of oscillation aligned on an wheel set axis formed by the axis of said arbor, wherein:

performing static balancing of said wheel set to bring a center of gravity onto said wheel set axis;

determining a desired value for a resulting unbalance moment of said wheel set about said wheel set axis, corresponding to a predetermined desired divergence between a first principal longitudinal axis of inertia of said wheel set, and said wheel set axis;

setting in rotation said wheel set at a predetermined speed about said wheel set axis, the resulting unbalance moment is measured with regard to said wheel set axis;

making an adjustment to a value of the resulting unbalance moment of said wheel set about said wheel set axis within a given determined tolerance with regard to said desired value;

performing said adjustment by machining both sides of a median plane including two secondary axes of inertia of said wheel set.

2. The method according to claim 1, wherein said adjustment is carried out by an asymmetrical addition and/or displacement and/or removal of material in relation to a plane perpendicular to said axis of said wheel set or equipped wheel set.

3. The method according to claim 1, wherein said adjustment is carried out by an asymmetrical addition and/or displacement and/or removal of material in relation to a plane defined by two secondary axes of inertia of said wheel set or equipped wheel set.

4. The method according to claim 1, wherein an addition and/or displacement and/or removal of material is carried out on at least one flange comprised in said wheel set or said equipped wheel set, projecting radially in relation to said arbor.

5. The method according to claim 4, wherein machined portions are formed, on both sides of said median plane, with different volumes with respect to said wheel set axis.

6. The method according to claim 4, wherein machined portions are formed, on both sides of said median plane, with different radial positioning with respect to said wheel set axis.

7. The method according to claim 4, wherein machined portions are formed, on both sides of said median plane, axially parallel to said wheel set axis, from a same side of said flange.

8. The method according to claim 4, wherein machined portions are formed, on both sides of said median plane, axially parallel to said wheel set axis, on opposite sides of said flange.

9. The method according to claim 4, wherein, prior to said static balancing of said wheel set or of said equipped wheel set, said flange is machined to be out of truth in the flat by a determined value, with a resulting unbalance moment in a specific angular direction and having a predetermined value, and off-center in relation to said median plane.

10. The method according to claim 9, wherein said flange is made with portions of excess thickness, on both sides of said median plane, which substantially define together a plane passing through said wheel set axis, said portions of excess thickness forming together a controlled unbalance, and correction is forced in a certain area around said plane.

11. The method according to claim 2, wherein the addition and/or displacement and/or removal of material is carried out on said arbor of said wheel set or of said equipped wheel set.

12. The method according to claim 2, wherein the addition and/or displacement and/or removal of material is carried out on at least one arm comprised in said wheel set between said arbor and another off-center part of said wheel set or of said equipped wheel set.

13. The method according to claim 1, wherein said static balancing is performed prior to said adjustment of a value of a dynamic balancing moment.

14. The method according to claim 1, wherein said static balancing is performed simultaneously with said adjustment of a value of a dynamic balancing moment.

15. The method according to claim 1, wherein said desired value of the resulting unbalance moment of the wheel set or equipped wheel set about said wheel set axis is set at zero, so as to make said first principal longitudinal axis of inertia of said wheel set or said equipped wheel set coincident with said wheel set axis.

16. The method according to claim 1, wherein said predetermined speed of rotation is set at a maximum angular speed calculated for said wheel set or equipped wheel set, considered during pivoting or oscillation thereof in service, in combination with at least one drive means, and/or a specific elastic means of return or repulsion, and/or magnetic means of return or repulsion, and/or electrostatic means of return or repulsion.

17. The method according to claim 2, wherein, prior to said static balancing and dynamic balancing, at least one flange, comprised in said wheel set or equipped wheel set, is machined with cylindrical or fluted housings arranged to receive cylindrical or fluted masses movable in an axial direction parallel to said wheel set axis, and all or part of said adjustment is accomplished by the displacement of said movable masses inserted in said housings in relation to said plane defined by the two secondary axes of inertia of said wheel set or equipped wheel set.

18. The method according to claim 17, wherein, prior to said static balancing and said dynamic balancing, said movable masses are confined in and made inseparable from said flange, either during a creation of a monobloc of said wheel set or equipped wheel set in a single piece with said movable masses, or by extending at least one end of each said movable mass to prevent an extended area from passing through the corresponding housing for said movable mass.

19. The method according to claim 1, wherein all or part of said adjustment is accomplished by deformation of at least one flange, comprised in said wheel set or equipped wheel set, in an asymmetrical manner in relation to said plane defined by the two secondary axes of inertia of said wheel set or equipped wheel set.

20. The method according to claim 1, wherein, prior to said static balancing and dynamic balancing, at least one flange, comprised in said wheel set or equipped wheel set, is machined with internally threaded radial housings, arranged to receive asymmetrical headed screws movable in a radial direction in relation to said wheel set axis, and all or part of said adjustment is accomplished by displacement of said screws screwed into said internally threaded housings.

21. The method according to claim 1, wherein, when the resulting unbalance moment of said wheel set or equipped wheel set is measured in relation to said wheel set axis, an unbalance is noted in an angular position in relation to an angular guide-mark comprised in said wheel set or equipped wheel set.

22. A wheel set for a scientific instrument or timekeeper, comprising:

at least one arbor arranged to pivot or oscillate about an oscillation axis aligned on a wheel set axis formed by an axis of said arbor, and including at least one flange connected to said wheel set arbor and projecting radially in relation to said arbor, said at least one flange being substantially perpendicular to said wheel set axis, wherein said wheel set is manufactured to include a first principal longitudinal axis of inertia close to said wheel set axis or coincident therewith, the two secondary axes of inertia defining together a median plane, and said flange includes an elongate adjustment screw which is rotatable with respect to a radial line originating from said wheel set axis such that a longitudinal axis of the adjustment screw rotates only within a plane perpendicular to the radial line.

23. The wheel set for a scientific instrument or timekeeper according to claim 22, wherein said median plane is within a thickness of said flange.

24. The wheel set according to claim 22, wherein said flange is machined to be out of truth in the flat by a predetermined value, with a resulting unbalance moment in a specific angular direction and having a predetermined value, and off-center in relation to said median plane.

25. The wheel set according to claim 24, wherein said flange includes portions of excess thickness, on both sides of said median plane, and substantially define together a plane passing through said wheel set axis, said portions of excess thickness forming together a controlled unbalance.

26. An equipped wheel set for a scientific instrument or timekeeper including a wheel set according to claim 22, wherein the equipped wheel set also includes a drive mechanism, and/or an elastic mechanism of return or repulsion, and/or a magnetic mechanism of return or repulsion, and/or an electrostatic mechanism of return or repulsion.

27. A mechanism for a scientific instrument or timekeeper including an equipped wheel set according to claim 26.

28. A scientific instrument including a mechanism according to claim 27.

29. The scientific instrument according to claim 28, wherein said instrument is a watch and said wheel set is a balance wheel.

30. The wheel set according to claim 22, wherein the radial line does not pass through a midpoint of the adjustment screw.

* * * * *